United States Patent [19]

Binkley

[11] 4,021,209

[45] May 3, 1977

[54] ARAMID FIBER REINFORCED ABRASIVE WHEEL

[75] Inventor: Howard J. R. Binkley, North Tonawanda, N.Y.

[73] Assignee: Federal-Mogul Corporation, Detroit, Mich.

[22] Filed: July 23, 1975

[21] Appl. No.: 598,302

[52] U.S. Cl. ..... 51/298 A; 51/293
[51] Int. Cl.[2] ..... C09K 3/14
[58] Field of Search ..... 51/206, 209, 297, 298

[56] References Cited

UNITED STATES PATENTS

| | | | |
|---|---|---|---|
| 2,698,504 | 1/1955 | Lotz | 51/297 |
| 3,116,986 | 1/1964 | Goepfert et al. | 51/297 |
| 3,487,589 | 1/1970 | Binkley | 51/206 |
| 3,540,163 | 11/1970 | Shoemaker | 51/209 |
| 3,719,007 | 3/1973 | Bevard | 51/297 |
| 3,867,795 | 2/1975 | Howard | 51/209 |
| 3,888,965 | 6/1975 | Kwolek | 264/346 |

*Primary Examiner*—Donald J. Arnold
*Attorney, Agent, or Firm*—Robert F. Hess

[57] ABSTRACT

An improved abrasive grinding wheel such as a cutoff or snagging wheel, including a reinforcing fabric of aramid fibers.

1 Claim, No Drawings

ARAMID FIBER REINFORCED ABRASIVE WHEEL

BACKGROUND OF THE INVENTION

1. Field of the Invention

The present invention relates generally to an improved fiber reinforced abrasive grinding wheel wherein the improvement is the selection of the particular fiber reinforcement material.

2. Description of the Prior Art

The most successful fiber reinforcement for abrasive grinding wheels is generally known to be fiberglass. It has been used in all types of wheels for various applications. An example of this is shown in U.S. Pat. No. 3,487,589 to H. J. R. Binkley, assigned to the assignee of the present invention, where there is shown a cutoff wheel having fiberglass reinforcement fabric of a particular weave on both sides of the wheel. As a second example there is U.S. Pat. No. 3,867,795 to Howard which discloses a snagging wheel having various laminations of fiberglass fabric and wherein the invention lies in the use of alumina-zirconia abrasive particles to give superior cutting performance. The prior art is replete with other examples of reinforced wheels and it can be generally said that fiberglass is the most successful today irrespective of the particular wheel type, composition, weave, or whatever because of its high tensile strength.

SUMMARY OF THE INVENTION

My invention is the use of aramid fibers as a reinforcement and general substitute for fiberglass in the production of grinding wheels.

DESCRIPTION OF THE PREFERRED EMBODIMENT

There are two unexpected advantages of using aramid fibers in place of fiberglass. Fibers comprised of aromatic polyamides where at least 85% of the amide linkages are attached directly to two aromatic rings have been designated as aramids by the Federal Trade Commission. First, the aramid fibers in addition to being stronger are more flexible. This makes a wheel which includes this fiber as a reinforcement more resistant to shear and in the event of damage to the wheel, the fiber will better be able to hold the wheel together until the defect is detected. This is especially true in a cutoff wheel, as shown in U.S. Pat. No. 3,487,589 to Binkley, which is pinched in a cut and flexed to the extent that numerous bond posts are broken. The aramid fabric being much more resistant to shear will show this advantage. Second, this quality makes it possible to utilize more of the inherent tensile strength of aramid fibers to hold the wheel together at higher rotational speeds.

These facts are born out by an over-speed test which was run on 10 inches × 3/32 inch × 5/8 inch wheels of identical structure namely:

36 $Al_2O_3$ — 90%
Bakelite 5215 — 10%
Furfural Solvent Wetting Agent
One layer of Woven Fabric Inside
One Ton Per Square Inch Pressure
Cure in the Conventional Manner The only difference between the two above described test wheels was the type of reinforcing fiber used. One used fiberglass while the other used aramid fiber PRD-49. Such aramid has the following properties:

Density — 1.45 g/cc
Filament diameter — 0.00047 inch
Fiber elongation — 2.8% (ASTM D 2343-67)
Tensile strength — 525,000 PSI (ASTM D 2343-67)
Specific tensile — $10 \times 10^6$ inch (ASTM D 2343-67)
Modulus — $19 \times 10^6$ PSI
Environmental stability — −320° to 400° F.
Specific modulus — $3.5 \times 10^8$ in.

When destruction occurred, the aramid fiber wheel had attained a 10% higher speed than had the fiberglass wheel. More importantly, the remaining pieces clearly demonstrated the superiority of the aramid fabric for shear resistance.

Weaves such as plain, lino, and roving may be suitable for particular applications. Likewise, it is also within the scope of my invention to use the same aforestated reinforcing material in other abrasive wheel designs presently made with conventional reinforcement.

In addition to aramid fiber PRD-49, the aramid fiber DP-01 is another product that should be considered when it becomes available. The possibility exists that these materials need not be resin treated. This being the case, a much improved shelf life would be attained where no perishable resins are involved.

No particular significance is placed upon the number of reinforcing plys nor their particular placement within the composition of the wheel core since it is obvious the advantage of my invention will apply to all such arrangements with the only exception that with my invention the number of plys and/or the weight of each ply may be reduced without sacrificing strength over the conventional reinforced wheel.

To those skilled in the art to which this invention relates, many changes in construction and widely differing embodiments and applications of the invention will become evident without departing from the scope and spirit of the invention. The disclosures and descriptions herein are purely illustrative and are not intended in any sense to be limiting.

I claim:

1. An abrasive wheel comprising a core portion and a grinding surface portion comprising a mass of abrasive material, synthetic resin binder, and aramid reinforcing fibers said aramid reinforcing fibers are in the form of a woven open-mesh fabric, said fabric being positioned as at least one uniform radial layer perpendicular to the axis of rotation of said wheel.

* * * * *